US007774936B2

(12) United States Patent
Kroner et al.

(10) Patent No.: US 7,774,936 B2
(45) Date of Patent: Aug. 17, 2010

(54) CATALYTIC CONVERTER AND ASSOCIATED METHOD OF ASSEMBLY

(75) Inventors: Peter Kroner, Augsburg (DE); James R. Bowman, Indianapolis, IN (US); Kevin Barnard, Franklin, IN (US)

(73) Assignee: EMCON Technologies LLC, Wilmington, DE (US)

( * ) Notice: Subject to any disclaimer, the term of this patent is extended or adjusted under 35 U.S.C. 154(b) by 1419 days.

(21) Appl. No.: 10/909,822

(22) Filed: Aug. 2, 2004

(65) Prior Publication Data

US 2006/0024215 A1 Feb. 2, 2006

(51) Int. Cl.

| | |
|---|---|
| ***B01D 50/00*** | (2006.01) |
| ***B21D 39/03*** | (2006.01) |
| ***B23P 15/26*** | (2006.01) |
| ***B23P 19/02*** | (2006.01) |

(52) U.S. Cl. ..... 29/890; 29/890.036; 29/234; 29/428; 422/177; 422/179; 422/180

(58) Field of Classification Search ..... 29/890, 29/890.036, 234, 235, 428; 422/177, 179, 422/180

See application file for complete search history.

(56) References Cited

U.S. PATENT DOCUMENTS

| | | | | | |
|---|---|---|---|---|---|
| 4,235,846 | A | * | 11/1980 | Abthoff et al. | 422/171 |
| 4,278,639 | A | * | 7/1981 | Tadokoro et al. | 422/171 |
| 4,413,392 | A | * | 11/1983 | Otani et al. | 29/890 |
| 4,425,304 | A | * | 1/1984 | Kawata et al. | 422/171 |
| 4,969,264 | A | * | 11/1990 | Dryer et al. | 29/890 |
| 5,094,073 | A | * | 3/1992 | Worner et al. | 60/299 |
| 5,118,476 | A | | 6/1992 | Dryer et al. | |
| 5,119,551 | A | * | 6/1992 | Abbott | 29/890 |
| 5,140,813 | A | * | 8/1992 | Whittenberger | 60/300 |
| 5,329,698 | A | * | 7/1994 | Abbott | 29/890 |
| 5,943,771 | A | * | 8/1999 | Schmitt | 29/890 |
| 6,086,829 | A | * | 7/2000 | Shea et al. | 422/179 |
| 6,317,976 | B1 | * | 11/2001 | Aranda et al. | 29/890 |
| 6,824,744 | B1 | * | 11/2004 | Stoepler et al. | 422/179 |
| 7,241,426 | B2 | * | 7/2007 | Hardesty et al. | 422/177 |
| 7,452,512 | B2 | * | 11/2008 | Quackenbush | 422/171 |
| 2004/0197242 | A1 | | 10/2004 | Holden et al. | |
| 2005/0005446 | A1 | * | 1/2005 | Mayfield | 29/890 |

FOREIGN PATENT DOCUMENTS

| | | |
|---|---|---|
| JP | 2000-073755 A | 3/2000 |
| WO | 9928604 | 6/1999 |

OTHER PUBLICATIONS

PCT International Search Report for PCT/US05/25411, Jan. 5, 2007, 1 pg.

Drawings of Catalytic Converters (3 pages) (before Aug. 2, 2003).

* cited by examiner

*Primary Examiner*—David P Bryant
*Assistant Examiner*—Alexander P Taousakis
(74) *Attorney, Agent, or Firm*—Pamela A. Kachur

(57) ABSTRACT

A catalytic converter comprises an outer tube, a pair of catalyzed substrates positioned in the outer tube, and a heat shield positioned in the outer tube between the catalyzed substrates. A method of assembling the catalytic converter is also disclosed.

23 Claims, 6 Drawing Sheets

CATALYTIC CONVERTER AND ASSOCIATED METHOD OF ASSEMBLY

FIELD OF THE DISCLOSURE

The present disclosure relates to catalytic converters.

BACKGROUND OF THE DISCLOSURE

Catalytic converters are used to treat emissions present in exhaust gas discharged from an engine or other producer of exhaust gas. Such emissions may include, for example, carbon monoxide (CO), unburned hydrocarbons (HC), and nitrogen oxides ($NO_x$). The catalytic converter may be used to convert CO to carbon dioxide ($CO_2$), HC to water ($H_2O$), and ($NO_x$) to nitrogen before discharge of the exhaust gas to the atmosphere.

SUMMARY OF THE DISCLOSURE

According to an aspect of the present disclosure, a catalytic converter comprises an outer tube formed without any weld, first and second catalyzed substrates, and a tubular heat shield. The first catalyzed substrate is secured in a tubular first side portion of the outer tube. The second catalyzed substrate is secured in a tubular second side portion of the outer tube. The heat shield is positioned in a tubular intermediate portion located between the first and second side portions to inhibit transfer of heat from exhaust gas present in the intermediate portion to the intermediate portion. An oxygen sensor is secured to the intermediate portion to sense the oxygen content of the exhaust gas located between the catalyzed substrates.

According to an aspect of a method of assembling the catalytic converter, a diameter of the first side portion is reduced to secure the first catalyzed substrate in the first side portion and a diameter of the second side portion is reduced to secure the second catalyzed substrate in the second side portion. Such diameter reduction of one or both of the first and second side portions occurs after insertion of the heat shield into the intermediate portion.

DETAILED DESCRIPTION OF THE DRAWINGS

Figure 1:
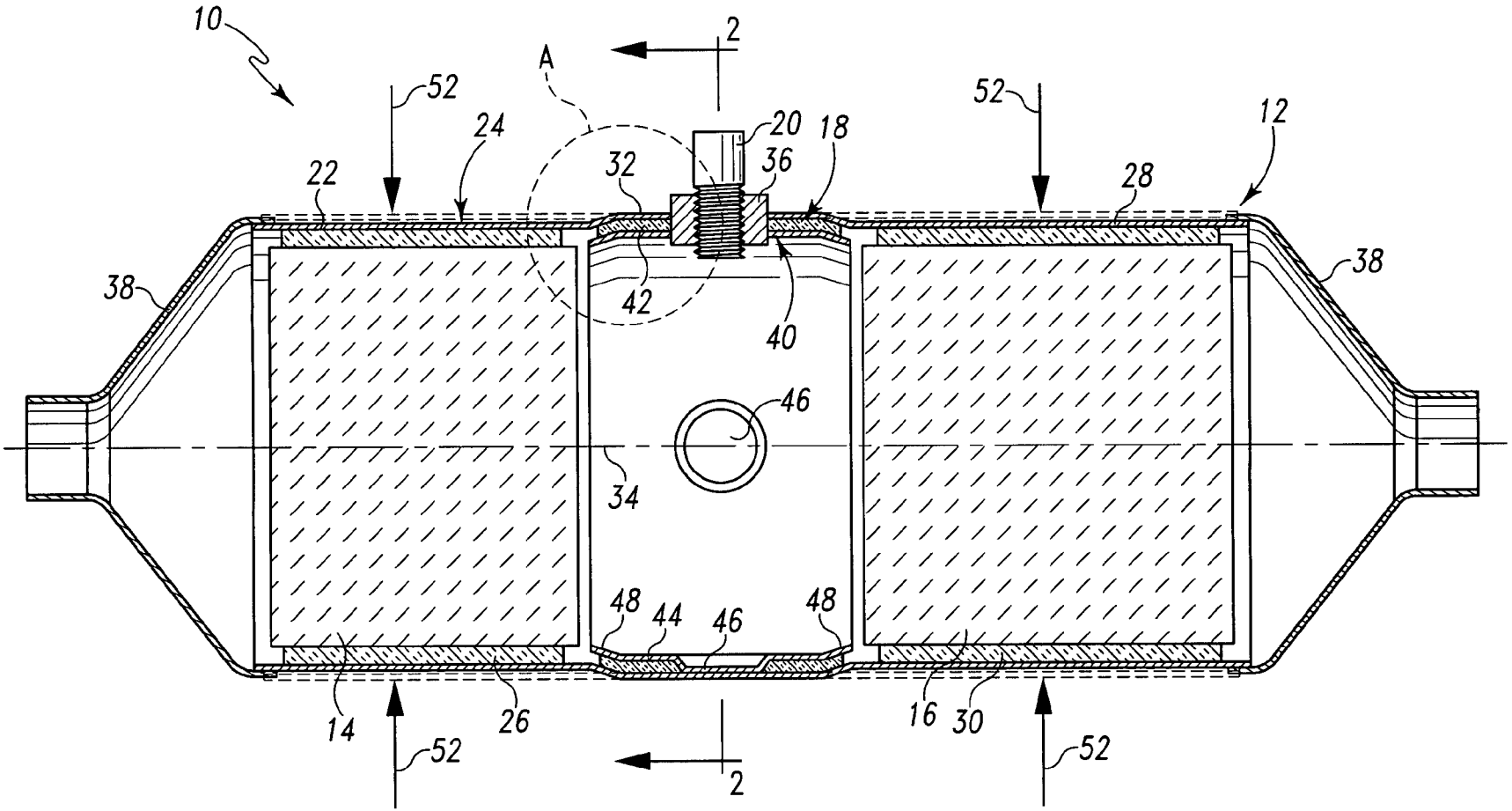
FIG. 1 is a longitudinal sectional view of a catalytic converter showing a first heat shield and an oxygen sensor secured to a tubular intermediate portion of an outer tube and first and second catalyzed substrates secured to reduced-diameter tubular side portions of the outer tube.

While the concepts of the present disclosure are susceptible to various modifications and alternative forms, specific exemplary embodiments thereof have been shown by way of example in the drawings and will herein be described in detail. It should be understood, however, that there is no intent to limit the disclosure to the particular forms disclosed, but on the contrary, the intention is to cover all modifications, equivalents, and alternatives following within the spirit and scope of the invention as defined by the appended claims.

Referring to FIG. 1, a catalytic converter 10 is configured for treating emissions present in exhaust gas discharged from an engine (not shown) or other exhaust gas producer. Converter 10 is used, for example, to convert CO to $CO_2$, HC to $H_2O$, and $NO_x$ to nitrogen.

Converter 10 comprises a housing 12, first and second catalyzed substrates 14, 16, a tubular heat shield 18, and an oxygen sensor 20. Catalyzed substrates 14, 16 are configured to treat the emissions in the exhaust gas. Each catalyzed substrate 14, 16 comprises a substrate that is made of, for example, a ceramic material such as cordierite and is coated with a catalyst such as platinum, palladium, and/or rhodium. Substrate 14 is secured in a tubular first side portion 22 of an outer tube 24 of housing 12 by use of, for example, a first support mat 26 positioned between substrate 14 and first side portion 22 and made of intumescent or fiberglass material. Substrate 16 is secured in a tubular second side portion 28 of outer tube 24 by use of, for example, a second support mat 30 positioned between substrate 16 and second side portion 28 and made of intumescent or fiberglass material. Heat shield 18 is positioned in a tubular intermediate portion 32 of outer tube 24 around a longitudinal axis 34 of outer tube 24 to inhibit transfer of heat from exhaust gas present in intermediate portion 32 to intermediate portion 32. Oxygen sensor 20 is secured to intermediate portion 32 by use of, for example, a sensor mount 36 welded to intermediate portion 32 to sense the oxygen content of exhaust gas present between substrates 14, 16.

Each of side portions 22, 28 has a diameter smaller than a diameter of intermediate portion 32. The diameter of each of side portions 22, 28 is reduced during assembly of converter 10 to secure substrates 14, 16 in side portions 22, 28.

End caps 38 are secured to side portions 22, 28. Together, outer tube 24 and end caps 38 provide housing 12. Illustratively, end caps 38 are welded to outer tube 24. It is within the scope of this disclosure for one or both of end caps 38 to be formed as a one-piece construction with outer tube 24.

Figure 2:
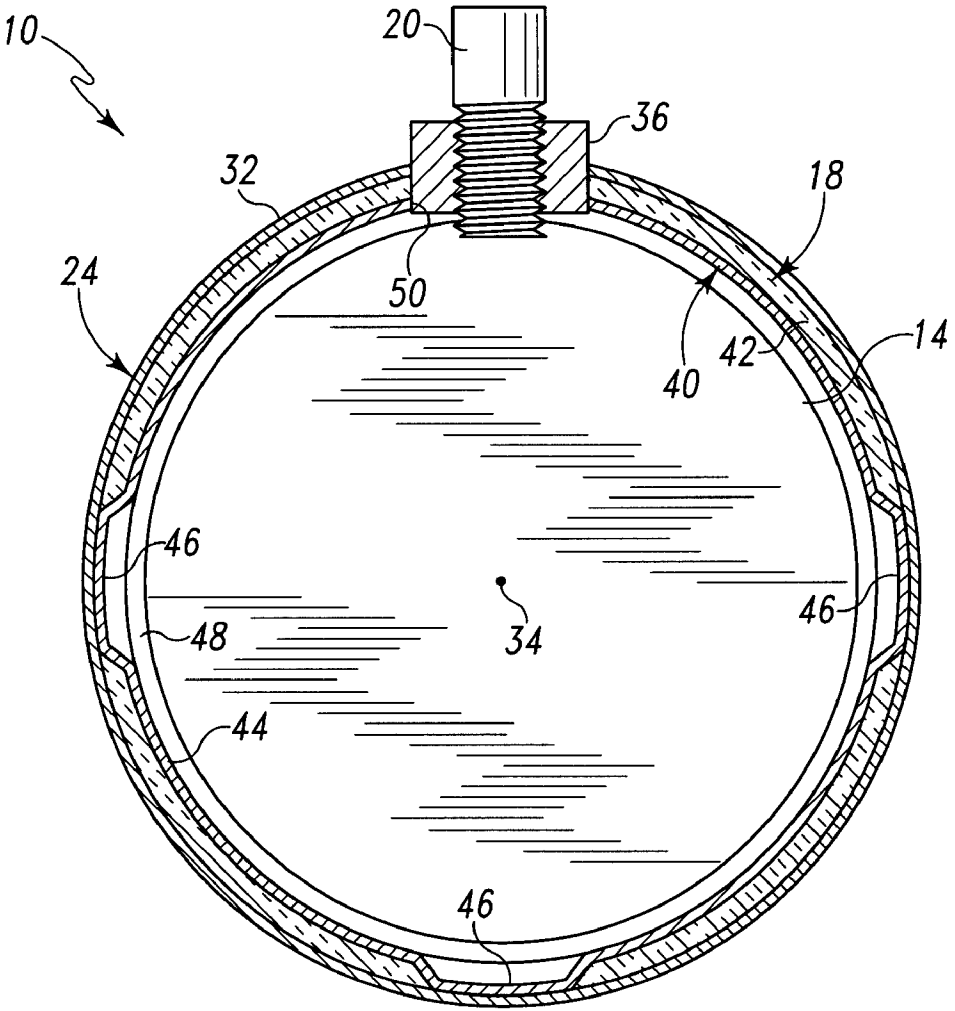
FIG. 2 is a transverse sectional view taken along lines 2-2 of FIG. 1 showing standoffs of an inner tube of the first heat shield secured to the intermediate portion and a insulation layer of the first heat shield located between the inner tube and the intermediate portion.
Figure 4:
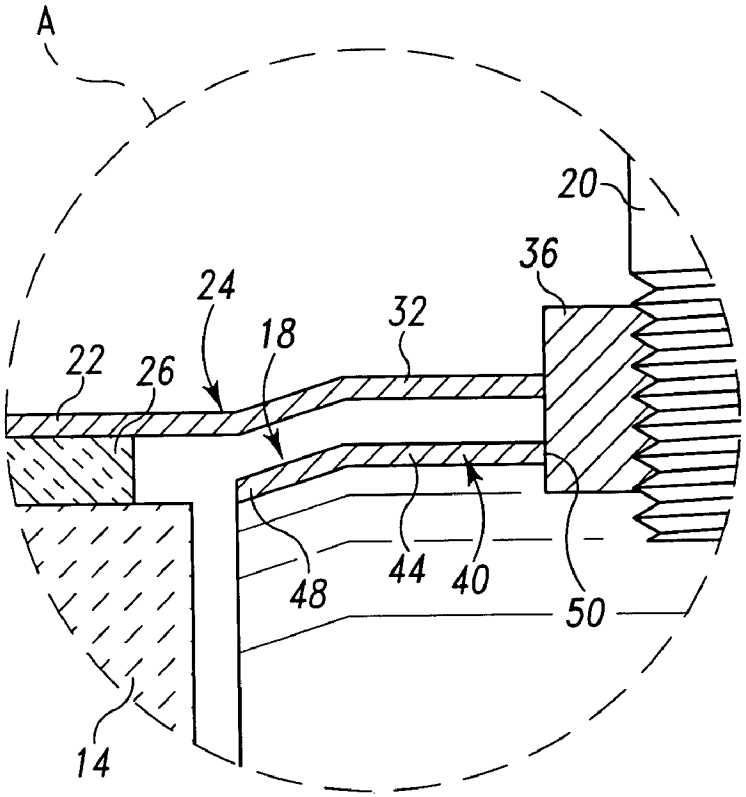
FIG. 4 is a view similar to FIG. 3 showing an air gap between the inner tube and the intermediate portion.
Figure 3:
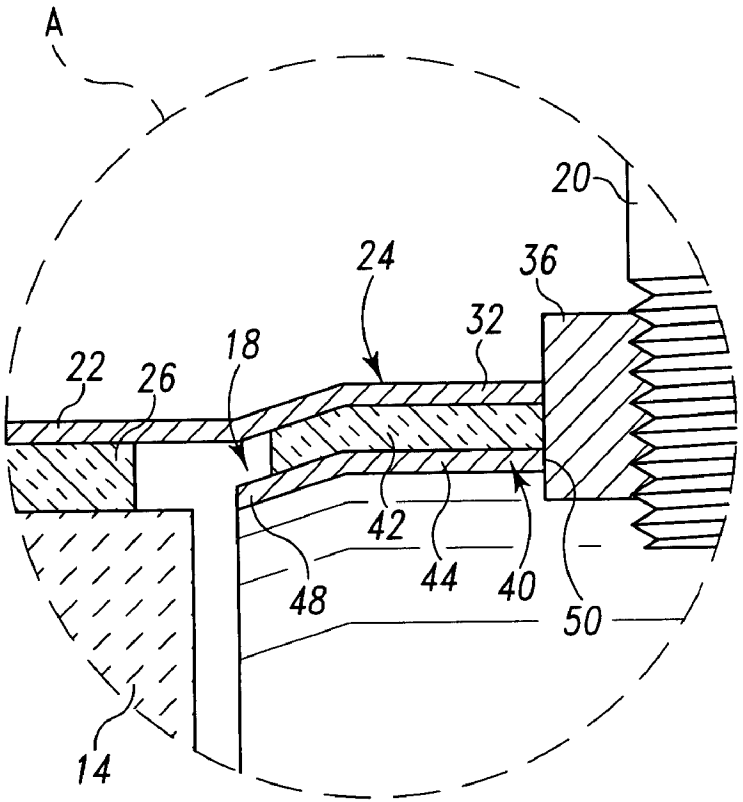
FIG. 3 is an enlarged view of region A of FIG. 1 showing the insulation layer located between the inner tube and the intermediate portion.

Referring to FIGS. 1-3, heat shield 18 comprises an inner tube 40 and a tubular insulation layer 42 positioned between inner tube 40 and intermediate portion. It is within the scope of this disclosure for layer 42 to be omitted from heat shield 18, as shown, for example, in FIG. 4.

Inner tube 40 comprises a tubular main body 44, a plurality (e.g., three) of standoffs 46, and opposite end portions 48, as shown, for example, in FIGS. 1 and 2. Standoffs 46 extend radially outwardly from main body 44 to intermediate portion 32 and are secured to intermediate portion 32 by, for example, spot-welding. End portions 48 taper radially inwardly from main body 44 to accommodate the difference in diameter between intermediate portion 32 and first and second side portions 22, 28. An aperture 50 defined in main body 44 receives sensor mount 36 to facilitate sensing of oxygen by oxygen sensor 20.

During assembly of converter 10 with heat shield 18, the diameter of side portions 22, 28 is initially the same as the diameter of intermediate portion 32. As such, outer tube 24 is initially cylindrical and has no welds.

Heat shield 18 is inserted through one of side portions 22, 28 into intermediate portion 32 and secured to intermediate portion 32. When heat shield 18 includes insulation layer 42, insulation layer 42 is positioned on inner tube 40 before heat shield 18 is inserted into intermediate portion 32. Standoffs 46 are spot-welded to intermediate portion 32 to secure heat shield 18 in place.

Catalyzed substrates 14, 16 are inserted into side portions 22, 28. First catalyzed substrate 14 is inserted into first side portion 22 and second catalyzed substrate 16 is inserted into second side portion 28.

Each side portion 22, 28 is swaged or otherwise deformed radially inwardly as indicated by arrows 52 from an initial undeformed position shown in phantom in FIG. 1 to a deformed position shown in solid in FIG. 1 to reduce the diameter of each side portion 22, 28. Such diameter reduction of side portions 22, 28 compresses support mats 26, 30 against substrates 14, 16 to hold substrates 14, 16 in place in side portions 22, 28. The diameter of each of side portions 22, 28 may be reduced in this manner after insertion of heat shield 18 into intermediate portion 32. In other cases, the diameter of one of side portions 22, 28 may be reduced before insertion of heat shield 18 into intermediate portion 32 and the diameter of the other side portion 22, 28 may be reduced after insertion of heat shield 18 into intermediate portion 32.

Sensor mount 36 may be secured to intermediate portion 32 and oxygen sensor 20 may be secured to mount 36 before or after reduction of the diameter of side portions 22, 28.

Figure 5:
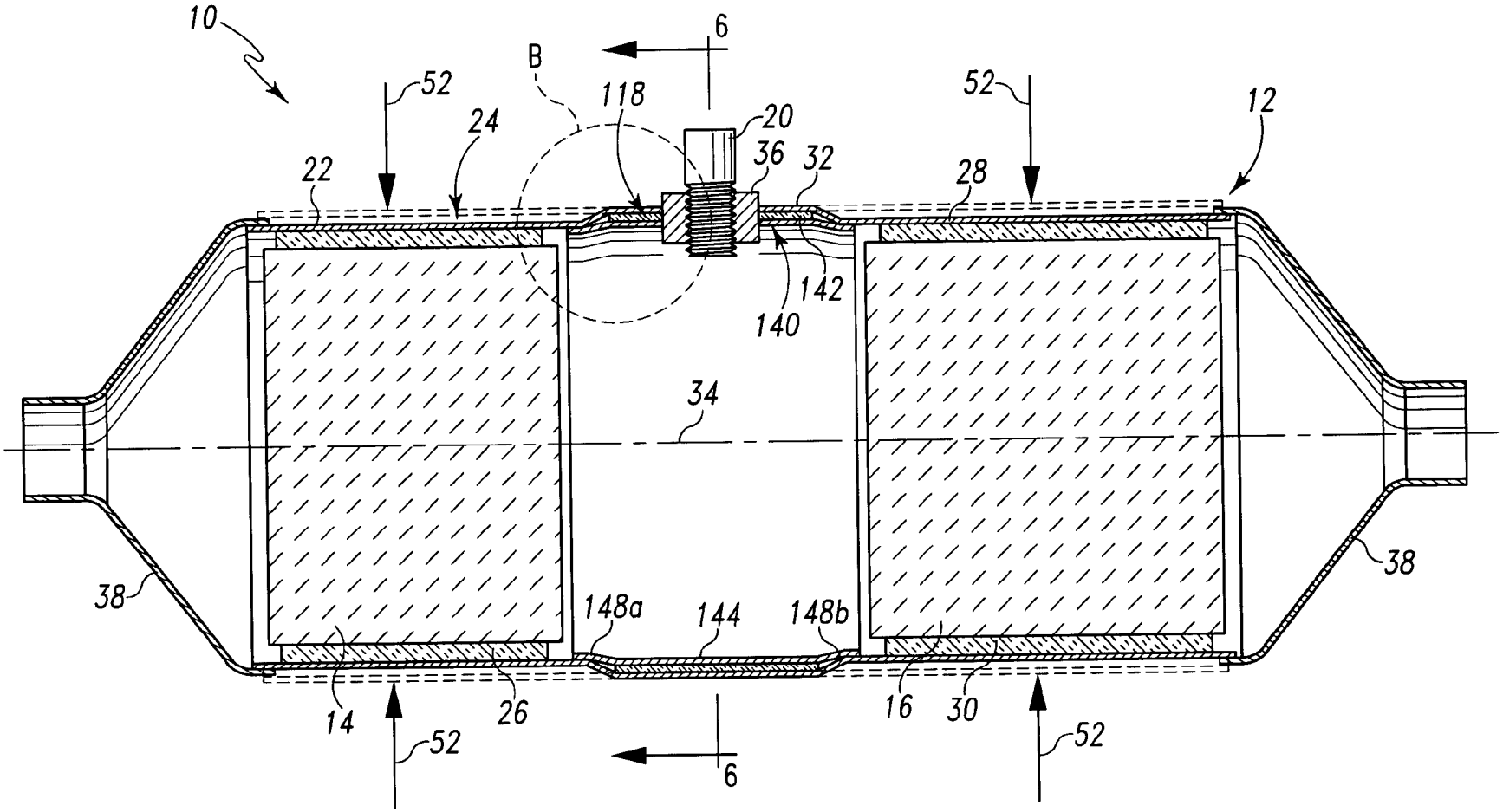
FIG. 5 is a longitudinal sectional view similar to FIG. 1 showing an inner tube of a second heat shield located in the intermediate portion and secured to the outer tube upon reduction of the diameter of the first and second side portions.
Figure 6:
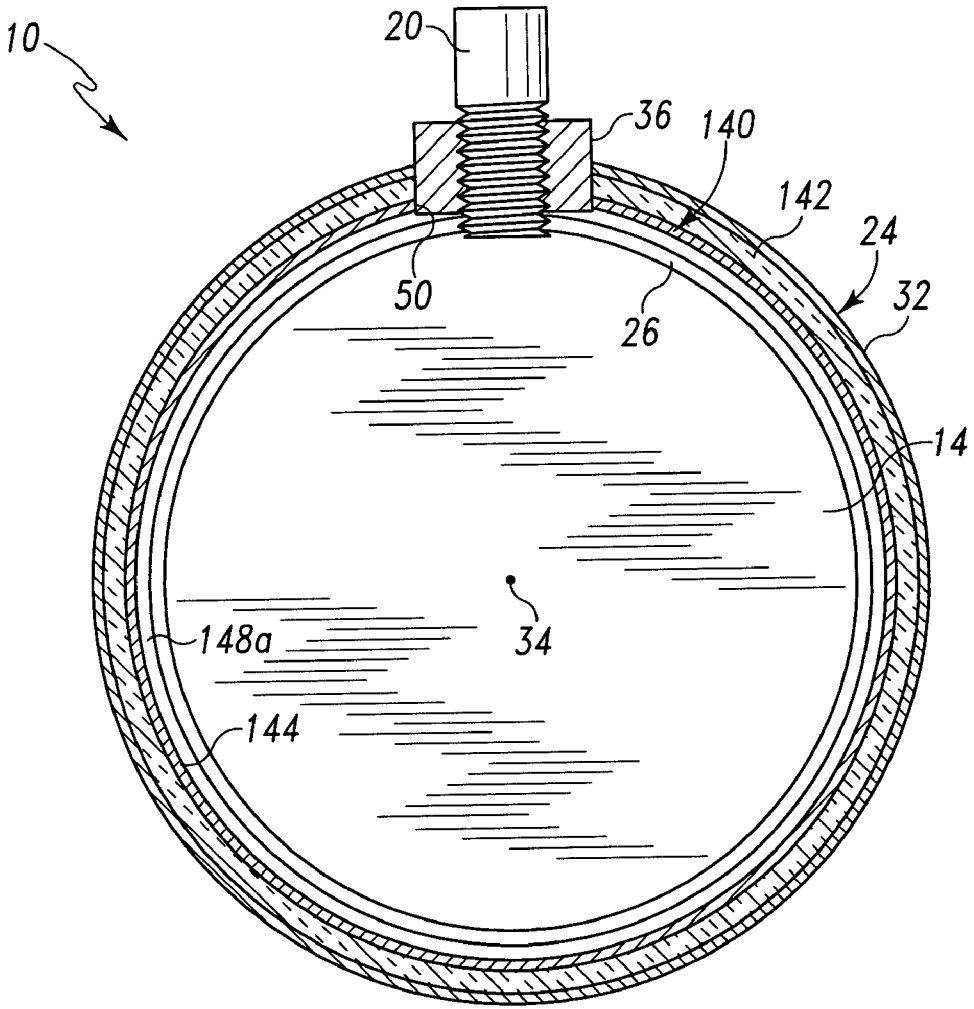
FIG. 6 is a transverse sectional view taken along lines 6-6 of FIG. 5.
Figure 7:
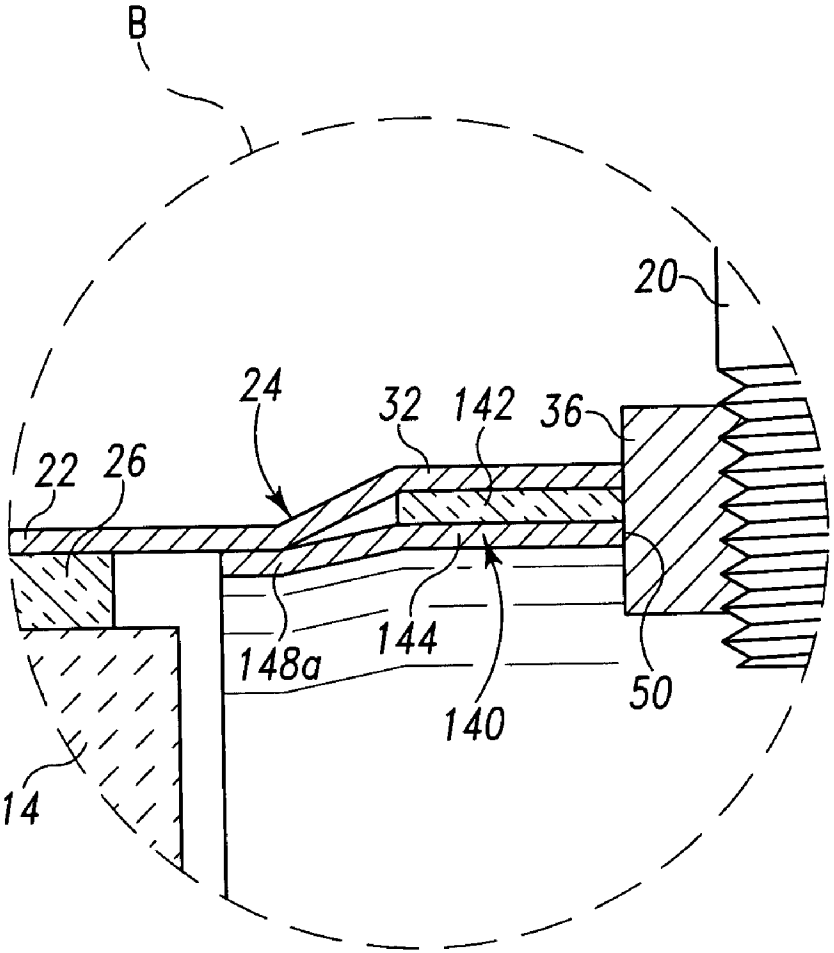
FIG. 7 is an enlarged view of region B of FIG. 5.

Referring to FIGS. 5-7, converter 10 comprises a heat shield 118 in place of heat shield 18. Heat shield 118 is secured to outer tube 24 in a manner different from the way heat shield 18 is secured to outer tube 24. In particular, heat shield 118 is secured to outer tube 24 as a result of reduction of the diameter of side portions 22, 28.

Heat shield 118 comprises an inner tube 140 and a tubular insulation layer 142 positioned between inner tube 140 and intermediate portion 32. Inner tube 140 comprises a main body 144 and opposite first and second end portions 148*a*, 148*b*. Side portions 22, 28 engage opposite end portions 148*a*, 148*b* and deform them radially inwardly to establish a mechanical lock between first side portion 22 and first end portion 148*a* and a mechanical lock between second side portion 28 and second end portion 148*b* as a result of reducing the diameter of side portions 22, 28. As such, inner tube 140 is secured to outer tube 24 without any welds.

It is to be understood that, as used herein, terms such as "tube," "tubular," "diameter," "cylindrical," and the like implicate a variety of cross-sectional shapes. Such cross-sectional shapes include, for example, a circular cross-sectional shape, an oval cross-sectional shape, a rectangular cross-sectional shape, and other closed curve cross-sectional shapes.

While the concepts of the present disclosure have been illustrated and described in detail in the drawings and foregoing description, such an illustration and description is to be considered as exemplary and not restrictive in character, it being understood that only the illustrative embodiments have been shown and described and that all changes and modifications that come within the spirit of the disclosure are desired to be protected.

There are a plurality of advantages of the concepts of the present disclosure arising from the various features of the systems described herein. It will be noted that alternative embodiments of each of the systems of the present disclosure may not include all of the features described yet still benefit from at least some of the advantages of such features. Those of ordinary skill in the art may readily devise their own implementations of a system that incorporate one or more of the features of the present disclosure and fall within the spirit and scope of the invention as defined by the appended claims.

The invention claimed is:

1. A method of assembling a catalytic converter comprising first and second catalyzed substrates, a tubular heat shield, and an outer tube comprising tubular first and second side portions and a tubular intermediate portion located between the first and second side portions, the method comprising the steps of:

inserting the heat shield into the intermediate portion, the first catalyzed substrate into the first side portion, and the second catalyzed substrate into the second side portion, after inserting the first catalyzed substrate into the first side portion, reducing a diameter of the first side portion relative to a diameter of the intermediate portion so as to secure the first catalyzed substrate in the first side portion, after inserting the heat shield into the intermediate portion and the second catalyzed substrate into the second side portion, reducing a diameter of the second side portion relative to the diameter of the intermediate portion so as to secure the second catalyzed substrate in the second side portion, wherein the first side portion extends substantially along an axial length of the first catalyzed substrate and the second side portion extends substantially along an axial length of the second catalyzed substrate, and wherein first and second diameters of the first and second side portions, respectively, remain generally constant along the axial lengths of the first and second catalyzed substrates.

2. The method of claim 1, comprising securing an oxygen sensor to the intermediate portion.

3. The method of claim 1, comprising securing the heat shield to the intermediate portion before at least one of the reducing steps.

4. The method of claim 3, wherein the heat shield comprises an inner tube, the inserting step comprises inserting the inner tube into the intermediate portion, and the securing step comprises securing the inner tube to the intermediate portion before at least one of the reducing steps.

5. The method of claim 4, wherein the inner tube comprises a standoff, and the securing step comprises welding the standoff to the intermediate portion before at least one of the reducing steps.

6. The method of claim 1, comprising securing the heat shield to the first and second side portions as a result of the reducing steps.

7. The method of claim 6, wherein the heat shield comprises an inner tube comprising opposite first and second end portions, the inserting step comprises inserting the inner tube into the intermediate portion, and the securing step comprises deforming the first and second end portions inwardly so as to establish a mechanical lock between the first end portion and the first side portion and between the second end portion and the second side portion as a result of the reducing steps.

8. The method of claim 1, wherein the heat shield comprises an inner tube, and the inserting step comprises inserting the inner tube into the intermediate portion before at least one of the reducing steps.

9. The method of claim 8, wherein the inserting step comprises establishing an air gap between the intermediate portion and the inner tube inserted into the intermediate portion.

10. The method of claim 8, wherein the heat shield comprises a tubular insulation layer surrounding the inner tube, and the inserting step comprises inserting the inner tube and the surrounding tubular insulation layer together into the intermediate portion before at least one of the reducing steps.

11. The method of claim 1, wherein the step of reducing the diameter of the first side portion comprises reducing the diameter of the first side portion to be less than the diameter of the intermediate portion, and the step of reducing the diameter of the second side portion comprises reducing the diameter of the second side portion to be less than the diameter of the intermediate portion.

12. The method of claim 1, wherein the step of reducing the diameter of the first side portion comprises swaging the first side portion after inserting the heat shield into the intermediate portion and the first catalyzed substrate into the first side portion, and the step of reducing the diameter of the second side portion comprises swaging the second side portion after inserting the heat shield into the intermediate portion and the second catalyzed substrate into the second side portion.

13. The method of claim 1, wherein during insertion of the heat shield into the intermediate portion a gap is provided between an outer surface of the heat shield and an inner surface of the intermediate portion.

14. The method of claim 13, including forming the gap to extend along a substantial axial length of the heat shield and about a substantial peripheral portion of the outer surface of the heat shield.

15. The method of claim 14, wherein the gap comprises an air gap that maintains an open space between the inner surface of the intermediate portion and the outer surface of the heat shield.

16. The method of claim 14, including positioning an insulation layer about the outer surface of the heat shield in the gap between the intermediate portion and the heat shield.

17. The method of claim 16, wherein the insulation is positioned on the heat shield prior to inserting the heat shield into the intermediate portion.

18. The method of claim 1, wherein the diameter of the first side portion comprises a first diameter, the diameter of the second side portion comprises a second diameter, and the diameter of the intermediate portion comprises a third diameter; and wherein the third diameter is greater than the first and the second diameters after the first and the second side portions have been respectively reduced to the first and second diameters.

19. The method of claim 1, including providing the intermediate portion and the heat shield with aligned openings to receive a sensor.

20. The method of claim 19, including inserting a sensor mount into the aligned openings and securing the sensor mount to the intermediate portion.

21. The method of claim 1 including providing the outer tube as a single-piece cylindrical tube with a diameter of the first side portion comprising a first diameter, the diameter of the second side portion comprising a second diameter, and the diameter of the intermediate portion comprising a third diameter, and wherein the first and third diameters are generally constant and equal to each other along an axial length of the first side portion and intermediate portion when the first catalyzed substrate is inserted into the first side portion, and wherein the second and third diameters are generally constant and equal to each other along an axial length of the second side portion and intermediate portion when the second catalyzed substrate is inserted into the second side portion, and wherein all reducing steps required to secure the first and second catalyzed substrates in the first and second side portions are performed after the inserting steps.

22. The method of claim 1 including providing the outer tube as a single-piece cylindrical tube having an initial outer diameter that is generally constant along a length of the outer tube during insertion of at least one of the heat shield and the first and second catalyzed substrates.

23. The method of claim 22 including performing all reducing steps required to secure the first catalyzed substrate in the first side portion subsequent to insertion of the first catalyzed substrate in the first side portion, and performing all reducing steps required to secure the second catalyzed substrate in the second side portion subsequent to insertion of the second catalyzed substrate in the second side portion.

* * * * *